US006655248B1

(12) United States Patent
Johnson

(10) Patent No.: US 6,655,248 B1
(45) Date of Patent: Dec. 2, 2003

(54) CHEESE CUTTING

(76) Inventor: Charles H. Johnson, 9337 Dahlia Dr., Minoqua, WI (US) 54548

( * ) Notice: Subject to any disclaimer, the term of this patent is extended or adjusted under 35 U.S.C. 154(b) by 74 days.

(21) Appl. No.: 09/944,458

(22) Filed: Aug. 30, 2001

(51) Int. Cl.[7] ..... B26D 1/553

(52) U.S. Cl. ..... 83/47; 83/77; 83/103; 83/932; 83/651.1; 225/103

(58) Field of Search ..... 83/932, 103, 651.1; 225/103

(56) References Cited

U.S. PATENT DOCUMENTS

| | | | | | |
|---|---|---|---|---|---|
| 9,953 | A | | 8/1853 | Duff | |
| 862,670 | A | * | 8/1907 | Simpson | 83/167 |
| 872,422 | A | * | 12/1907 | Hodell | 83/651.1 |
| 874,094 | A | * | 12/1907 | Low | 83/435.18 |
| 2,692,430 | A | | 10/1954 | Kraft et al. | 31/26 |
| 2,931,151 | A | * | 4/1960 | Simeone et al. | 53/514 |
| 3,599,689 | A | | 8/1971 | Grant | 146/158 |
| 3,980,235 | A | | 9/1976 | Kuhlman | 241/84 |
| 3,995,517 | A | * | 12/1976 | Smith | 83/13 |
| 4,018,116 | A | | 4/1977 | Treffner et al. | 83/4 |
| 4,208,931 | A | | 6/1980 | Collins | 83/44 |
| 4,217,818 | A | | 8/1980 | Hazen | 99/456 |
| 4,579,030 | A | | 4/1986 | Haas, Sr. et al. | 83/404.2 |
| 4,644,729 | A | | 2/1987 | Fessler | 53/157 |
| 4,646,602 | A | | 3/1987 | Bleick | 83/408 |
| 4,991,477 | A | | 2/1991 | Butt et al. | 83/35 |
| 5,271,304 | A | * | 12/1993 | Wygal et al. | 83/422 |
| 5,410,954 | A | | 5/1995 | Wygal et al. | 99/537 |
| 5,423,250 | A | | 6/1995 | Anderson et al. | 99/537 |
| 5,784,937 | A | | 7/1998 | Wygal et al. | 83/422 |
| 5,890,342 | A | * | 4/1999 | McDonald et al. | 53/54 |
| 5,974,925 | A | | 11/1999 | Lindee et al. | 83/412 |
| 6,003,417 | A | * | 12/1999 | Finkowski | 83/76 |

FOREIGN PATENT DOCUMENTS

| | | | | |
|---|---|---|---|---|
| GB | 2137468 | A | * 10/1984 | B26D/1/06 |

* cited by examiner

*Primary Examiner*—Allan N. Shoap
*Assistant Examiner*—John Windmuller
(74) *Attorney, Agent, or Firm*—Wilhelm Law Service; Thomas D. Wilhelm

(57) ABSTRACT

A cutter, preferably a cheese cutter, for cutting food into consumer-size chunks. The cutter comprises a feed conveyor, slab drive apparatus for driving a slab along the feed conveyor, and a cutting harp adjacent the discharge end of the feed conveyor. The cutting harp has cutting devices which make cuts extending across an opening. A slab discharged from the conveyor passes through the central opening, and the cutting devices cut the food product in the direction of advance of the slab. Transverse harp drive apparatus drives the harp transverse to the direction of advance of the slab, severing chunks of product from the slab. A take-away conveyor takes the severed chunks away from the cutting harp, to a weighing device which weighs the chunks. A controller receives weights from the weighing device, and sends adjustment instructions to the slab drive apparatus to adjust subsequent weights of product cut from such slabs.

18 Claims, 14 Drawing Sheets

CHEESE CUTTING

BACKGROUND

In making cheese, the product is typically first fabricated into blocks, such as cubes weighing about 640 pounds. Such 640 pound blocks are then processed through various cutting steps to make retail-size chunks. The focus of this invention is the process of breaking the large block down into the retail-size chunks.

In conventional processing, the e.g. 640 pound block of cheese is first passed through a block cutting harp having cutting wires oriented horizontally so as to cut the block into a stack of horizontally disposed slabs, stacked on top of each other. Such large blocks of cheese are pushed along a first conveyor through the block cutting harp by a block pusher having horizontally extending slots at respective elevations occupied by the cutting wires, such that the pusher block can be pushed part-way through the cutting harp, thus to push the entire length of the cheese block through the cutting harp. As illustrated in FIG. 1, multiple blocks of cheese can be pushed through the harp in serial order by a single push of the pusher whereupon the pusher is retracted to make room for placing additional blocks of cheese between the pusher and the harp.

After the block is cut into slabs, the next step is to separate the individual slabs from the stack of slabs which were cut from the block. In conventional practice, a respective slab is picked up from the block, and placed on a second conveyor leading to a second, slab-cutting harp. The second, slab-cutting harp has vertically oriented cutting wires for making vertical cuts along the length of the slab. A slab pusher much like the block pusher shown in FIG. 1, but optionally of lesser height, pushes the slab through the harp, then is retracted so a subsequent slab can be placed on the second, slab conveyor.

As the second pusher pushes the slab through the second harp, the harp cuts the cheese slab into a series of parallel elongate ribbons of cheese, each extending the full length of the slab. The slab is then passed to a third conveyor typically oriented 90 degrees to the second conveyor, whereby the ribbons of the slab are oriented transverse to the length of the conveyor. The slab is then pushed along the third conveyor by a third pusher through a third harp having vertically oriented cutting wires spaced across the width of the third conveyor, thus to cut the respective ribbons of cheese into shorter lengths for individual retail packaging.

After passing through the third harp, the cheese slab bears both longitudinal and transverse vertical cuts cutting the slab into respective chunks of cheese, sized e.g. for retail sale. Such chunks may be, for example and without limitation, as small as 4 ounces up to as great as 10 pounds per chunk.

While the slab has thus been cut into individual chunks, the respective individual chunks typically stick together, such that the chunks are not discrete pieces, but rather, are susceptible to being broken apart by manual handling and manipulation. While such manual breaking apart of an individual pair of chunks is not physically strenuous work, repeated such tasks result in accumulated excess stress on the hands and wrists of the workers who perform such tasks over the course of a work day. In particular, workers who perform such tasks for extended periods of time may be prone to develop carpal tunnel difficulties, or related repetitious work malady.

In addition, the labor cost of such manual breaking apart of the individual chunks of cheese adds significantly to the routine cost of making cheese.

Thus, in order to overcome such worker injury risks, and to reduce the cost of such labor, it is an object of the invention to provide apparatus for cutting individual chunks of cheese from a slab without any routine manual labor involved in separating the individual cut chunks from the slab.

It is another object to provide cutting harp apparatus which cuts the chunks both longitudinally and transversely while the slab travels a single straight line path, thus to be able to complete cutting the slab on a single straight conveyor.

It is yet another object to provide a single cutting harp which cuts the slab both in the longitudinal direction of movement of the slab, and transversely across the slab, thus to cut and sever individual consumer-size chunks of cheese at a single work station.

It is yet another object to provide a method of controlling the mass of the chunks of cheese being cut by weighing respective ones of the cut chunks, reporting the recorded weights to a controller, and wherein the controller sends corrective instructions to the drive mechanism driving the cheese through the cutting harp, thus to adjust the distance by which the leading edge of the slab or slab remainder is pushed through the harp before the harp makes the transverse cuts which release the chunks from the slab.

It is still another object of the invention to provide a method of advancing the slab of cheese through the cutting harp by confining the slab between an underlying feed conveyor and an overlying conveyor, biasing one of the conveyors toward the other, and engaging and impressing protuberances on facing surfaces of the conveyors against the top and/or bottom surface of the cheese slab, without penetrating or otherwise fracturing the surface of the slab of cheese, and then driving the conveyors to thus drive sequential slabs of cheese through the harp without having to retract pushing apparatus.

SUMMARY

In a first family of embodiments, the invention comprehends a cutter for cutting slabs of food product such as cheese into smaller chunks. The cutter comprises a feed conveyor having an intake end and a discharge end, and a conveying surface for conveying a such slab of food product thereon; slab drive apparatus for driving a slab of such food product along the feed conveyor from the intake end toward the discharge end; and a cutting harp disposed adjacent the discharge end of the feed conveyor. The cutting harp comprises a frame, a central opening inside the frame, and a plurality of cutting devices, such as cutting wires, operative to make cuts extending through the food product and across the opening from adjacent respective ones of the cutting devices. The opening is aligned with the feed conveyor such that a slab being discharged from the feed conveyor passes through the opening and such that, when such slab of food product is driven through the opening in the harp, the cutting devices effect cuts in such food product in the direction of advance of such slab of food product. The invention further comprises transverse harp drive apparatus, for driving the harp in a direction transverse to the direction of advance of the slab for severing chunks of the food product from the slab.

In preferred embodiments, the cutter is a cheese cutter.

The cutter preferably includes hold-down apparatus, such as a hold-down bar or a hold-down roller, mounted for reciprocal movement into and out of engagement with the slab of food product, adjacent the cutting harp for holding the food product against the feed conveyor while the harp is being driven in the transverse direction for severing the chunks of food product from such slab.

Preferably, the cutter apparatus preferably includes a take-away conveyor taking the severed chunks away from the cutting harp, and further includes a weighing device for weighing such chunks, and a controller receiving weight readings from the weighing device, and sending adjustment instructions to the slab drive apparatus to thereby adjust subsequent incremental predetermined distances.

In some embodiments, the invention includes a breaker bar downstream of and adjacent the harp for engaging top surfaces of the severed chunks and urging the chunks downwardly from the harp.

In preferred embodiments, the slab drive apparatus comprises the feed conveyor providing underlying support of the slab of food product at a feed conveyor support surface, and an overlying conveyor extending along the feed conveyor in facing relationship with the feed conveyor, for interfacing with the slab of food product at an overlying conveyance surface, a conveyance cavity thus being defined between the feed conveyor support surface and the overlying conveyor conveyance surface, the feed conveyor and the overlying conveyor being cooperatively driven at a common speed. At least one of the feed conveyor and the overlying conveyor is biased against the other of the feed conveyor and the overlying conveyor through the slab of food product, for advancing the slab of food product toward the cutting harp.

In some embodiments, at least one of the support surface and the conveyance surface, optionally both the support surface and the conveyance surface, comprise protrusions spaced about the respective surface for engaging the slab of food product and thereby assisting in advancing the slab of food product through the harp.

In preferred embodiments, the cutting wires on the harp are mounted to the frame by eccentric mounting wheels whereby the cutting wires can be moved transversely of a path of advance of the slab of food product by rotating respective ones of the mounting wheels.

In a second family of embodiments, the invention comprehends a method of controlling weight of chunks of food product cut from slabs of such food product. The method comprises, using slab driving apparatus, advancing a slab of a selected food product a predetermined first drive distance through a cutting harp comprising cutting devices such as cutting wires, and making longitudinal cuts of at least first predetermined lengths in the slab of food product. The method further includes, after making the cuts of first predetermined lengths, moving the harp transversely across the slab and thereby severing respective chunks of the food product from the slab. The method yet further includes weighing the chunks of food product so severed from the slab, and in a controller, comparing measured chunk weight against a predetermined desired chunk weight, determining an adjustment to the first predetermined distance, and sending a signal from the controller to the slab drive apparatus thereby adjusting the drive distance, and correspondingly adjusting the sizes of subsequently-cut chunks of the food product.

In some embodiments, the method includes stopping advance of the slab before moving the harp transversely to sever the chunks.

In preferred embodiments, the method includes advancing the slab of food product on a conveyor, and exerting a force holding the food product slab against the conveyor adjacent the harp while moving the harp transversely across the slab and severing the respective chunks from the slab.

In some embodiments, the method includes making the longitudinal cuts with a first cutting harp, and making the transverse cuts, which sever the chunks from the slab, with a second cutting harp.

Further to preferred embodiments, the method includes adjusting spacing between the cutting wires of the harp by rotating eccentric mounting wheels mounting the cutting wires to the harp frame, thus to move the cutting wires transversely of a path of advance of the slab, and thereby to adjust the distance between respective ones of the wires.

In a third family of embodiments, the invention comprehends a method of advancing a slab of cheese into and through a cutting harp, and thereby cutting the slab of cheese. The method comprises positioning the slab of cheese between a first underlying conveyor having a support surface, and a second overlying conveyor having a conveyance surface, wherein at least one of the first and second conveyors is biased against the other of the first and second conveyors through the slab of cheese. At least one of the first and second conveyors bears protrusions spaced about the respective surface and urged into a corresponding surface of the slab of cheese. The method further includes driving the first and second conveyors such that the protrusions, in combination with friction forces of the support surface and the conveyance surface, drive the slab of cheese into and through the cutting harp, thereby cutting the slab of cheese.

The method includes, in addition to making longitudinal cuts by advancing the cheese through the harp, moving the harp transversely across the slab and thereby severing respective chunks of cheese from the slab.

In preferred embodiments, both of the first and second conveyors bear protrusions spaced about the respective support surface and the conveyance surface such that protrusions on both of the first and second conveyors participate in driving the slab of cheese into and through the cutting harp.

In some embodiments, the method includes, on an ongoing basis, biasing a hold-down roller against a top surface of the slab of cheese between the overlying conveyor and the harp and thereby stabilizing the slab of cheese against substantial transverse movement while moving the harp transversely across the slab to thereby cut the cheese.

In some embodiments, the method includes intermittently biasing a hold-down bar against a top surface of the slab of cheese between the overlying conveyor and the harp and thereby stabilizing the slab of cheese against substantial transverse movement while moving the harp transversely across the slab.

Figure 1:
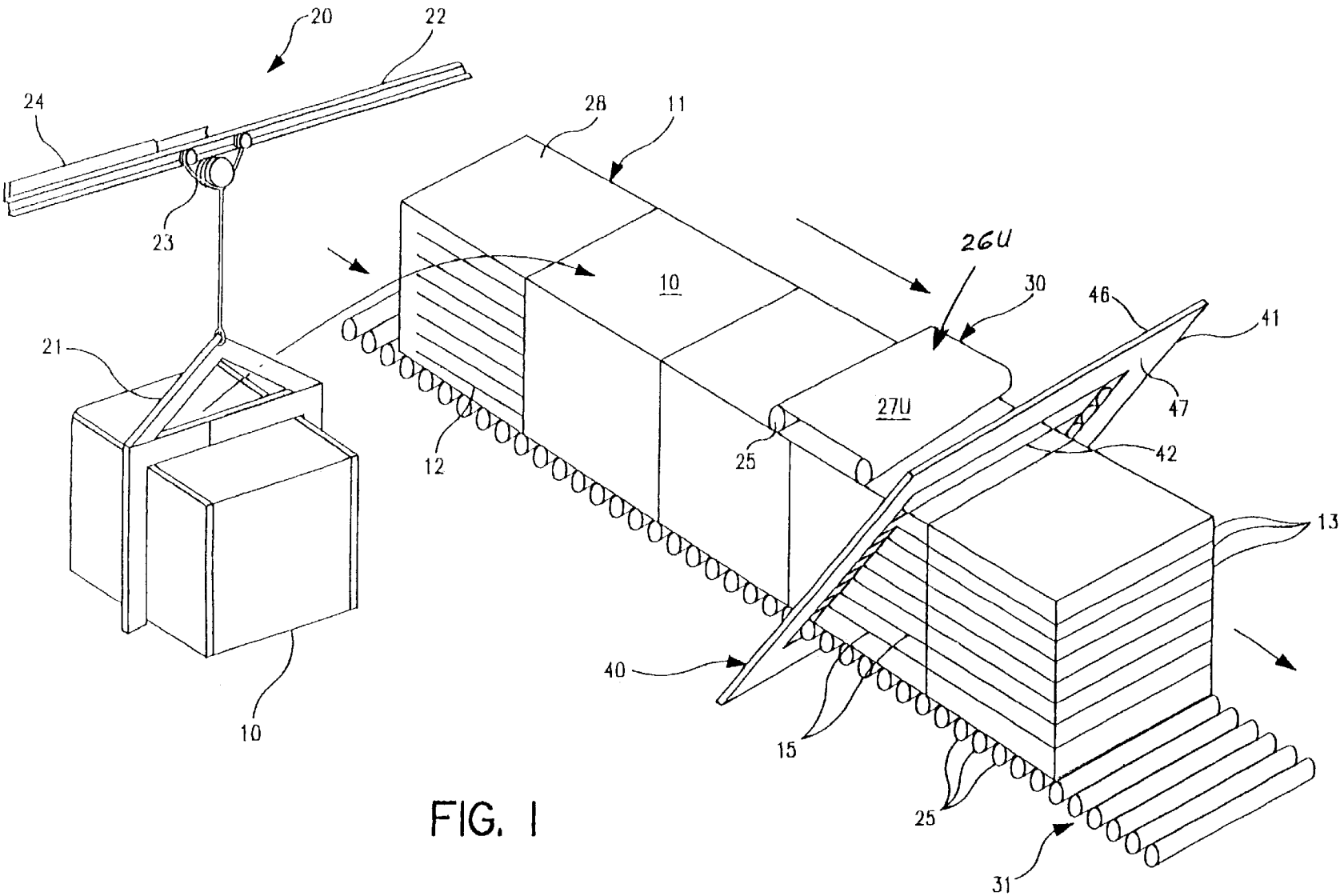
FIG. 1 is a pictorial representation of an overhead lift lifting and transporting a block of cheese toward a block conveyor where blocks are pushed, by a pusher, through a block harp having horizontal cutting wires to cut the respective blocks into slabs.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

FIG. 1 illustrates the initial stage of cutting a block of cheese 10 into the desired retail-size chunks. As seen in FIG. 1, an overhead crane 20 comprises clasp 21 mounted to rail 22 by roller assembly 23. Crane 20 is positioned over a block of cheese 10. When the clasp is appropriately positioned above the block of cheese, clasp 21 is opened and lowered over the cheese block. Clasp 21 is then closed to securely grip the cheese block and the block is lifted up. While the block is being held aloft, cylinder 24 or other motive power moves the pulleys along the length of rail 22 to an-unoccupied area of lower block conveyor 31 between pusher 11 and horizontally-cutting block harp 40. Lower block conveyor 31 receives blocks of cheese and supports the blocks as the blocks are pushed toward block cutting harp 40. Conveyor 31 includes a series of rollers 25 or other support structure defining a support surface underlying and supporting the blocks of cheese and facilitating moving the blocks of cheese toward and through harp 40.

Once crane 24 has been maneuvered such that the block of cheese is in a position directly over conveyor 31, the crane lift mechanism is then activated to lower the block onto the conveyor, and the clasp 21 is opened to thereby release the cheese block onto the conveyor. This process is repeated until a desired number of blocks have been placed on the lower block conveyor.

After a suitable number of blocks of cheese have been placed on block conveyor 31, the blocks are pushed by a pusher 11 toward and through harp 40. Pusher 11 includes a pusher body 28, and horizontal slots 12, extending inwardly into the body of the pusher, and aligned with respective ones of wires 42 in harp 40. Prior to activation to push one or more blocks of cheese through harp 40, and as shown in FIG. 1, pusher 11 is disposed at or adjacent one end of conveyor 31, remote from harp 40. When activated, pusher 11 pushes the one or more blocks of cheese on the conveyor, longitudinally along the length of the conveyor toward block harp 40. As pusher 11 advances the blocks of cheese toward harp 40, the blocks of cheese encounter upper block conveyor 30. The illustrated upper block conveyor 30 includes conveyor belt 26U, having conveyor belt surface 27U, and a plurality of rollers or gears 25 associated with guiding and driving belt 26U. In the alternative, the contacting surface of upper conveyor 30, which contacts the cheese blocks, can comprise intermittently-spaced conveyor rollers as the cheese contacting surface. Such rollers may be driven rollers or idler rollers.

Upper block conveyor 30 is located generally proximate harp 40, and directly above lower block conveyor 31. Upper block conveyor 30 is biased such that, when a block of cheese enters the space between the upper and lower block conveyors, the upper conveyor biases the respective block of cheese downwardly against the lower block conveyor. In the alternative, or in addition, lower conveyor 31 can be biased against upper conveyor 30.

One of the primary functions of upper block conveyor 30 is to resist any force exerted by a block of cheese in a direction upward and away from the lower block conveyor. Such upward force can occur as pusher 11 drives a block of cheese through block harp 40. Upper block conveyor 30 thus prevents a block of cheese from moving upwardly especially while the pusher pushes the block through harp 40. Upper block conveyor 30 can provide the indicated downward force by being configured such that the height of the block of cheese on the lower block conveyor is greater than the height of the space between the upper block conveyor and the lower block conveyor. In some embodiments, upper block conveyor can be positioned at a height above the lower block conveyor which is approximately the height of a cheese block. The height of the upper conveyor can, of course, be structured so as to be adjustable to accommodate a range of heights of cheese blocks, and may be spring-loaded to provide the indicated bias.

As pusher 11 advances cheese blocks along lower block conveyor, the blocks are fed into and through block harp 40. In general, the block harp includes a frame 41 defining an inwardly-disposed aperture, and a plurality of harp wires 42 extending generally horizontally across the aperture and spaced from each other by equal vertical distances. Thus, all the slabs produced by pushing a block 10 of cheese through block harp 40 have a common height. A typical such slab weighs about 128 pounds. Slab weights conventionally encountered in the cheese-making industry range from about 9 pounds to about 160 pounds, depending on the type of cheese being made and the desired weight and shape of the contemplated consumer-size end product. In the process illustrated in FIG. 1, sever cuts are made producing 8 slabs of about 80 pounds each.

As blocks 10 progress through block harp 40, harp wires 42 slice or cut the blocks into slabs 13 of cheese. As illustrated in FIG. 1, a so-sliced block of cheese leaves block harp 40 still in the shape of a block, but now cut into slabs stacked on top of each other.

Although sliced, the newly formed cheese slabs remain "stuck" together. The next step is to separate the slabs from each other for further processing of the slabs, individually.

Figure 2:
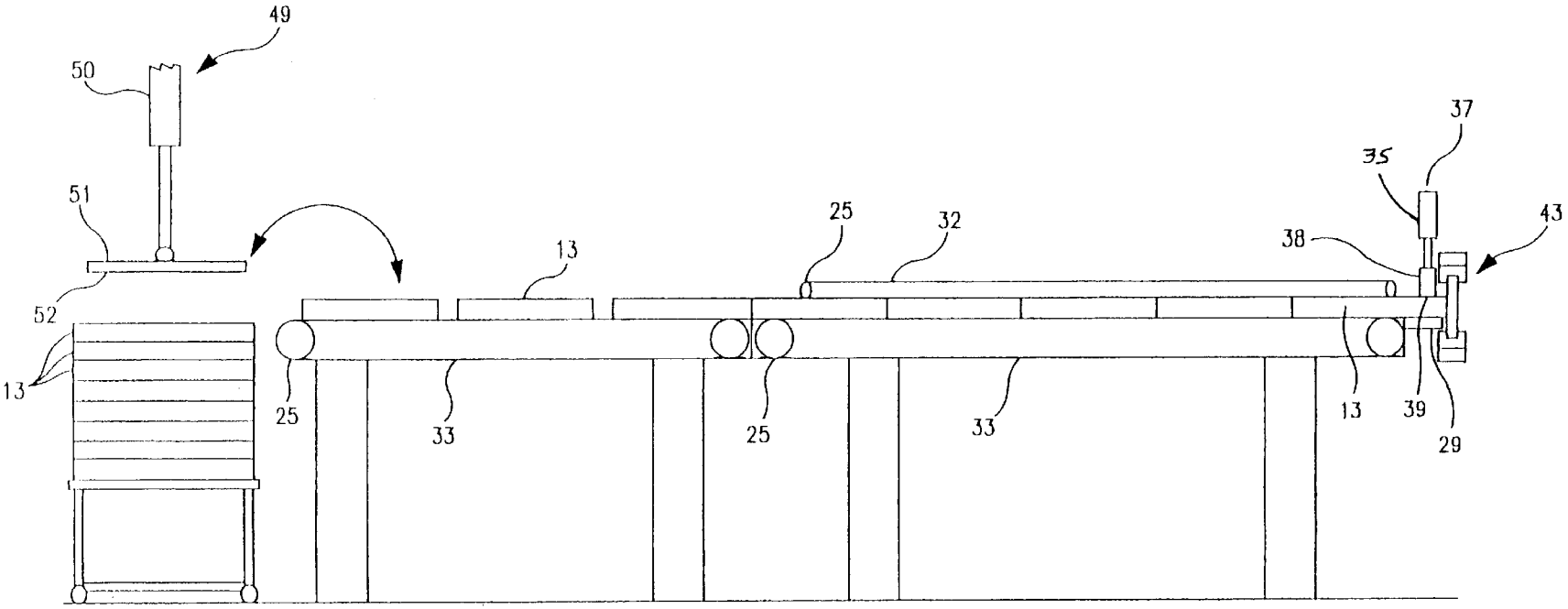
FIG. 2 is a side elevation view of slab cutting apparatus of the invention, including a suction device for lifting individual slabs of cheese from the block of stacked slabs, and underlying and overlying slab conveyors which drive slabs through a cutting harp.

Referring now to FIG. 2, slab lifter 49 comprises lifting cylinder 50 and suction plate 51. A suction surface 52 is located on the underside of suction plate 51. After blocks 10 have been sliced to produce slabs 13, the slabs are positioned proximate slab lifter 49 and the lifter is moved into alignment over one of the slabs. Lifter 49 is then lowered onto one of the slabs by activating cylinder 50. When suction surface 52 comes into contact with the top slab, movement of the slab lifter is halted and suction forces are activated. With suction being exerted through the bottom of plate 51, lifting cylinder 50 is activated, urging the respective slab of cheese upward for the purpose of separating the contacted slab from the next underlying slab.

In conventional practice, suction ports are evenly distributed over lower surface 52 of the suction plate, whereby the suction forces are evenly distributed over the suction surface. Using such conventional suction plate, the suction typically available to lift the slab is insufficient to release the slab being lifted, from the next underlying slab whereby, absent assistance in releasing the overlying slab from the underlying slab, the slabs will remain stuck to each other in spite of the lifting force being exerted at surface 52. Thus, it is known in the art to employ a worker, using a spatula or similar manually manipulated device, to manually separate one or more corners of the overlying slab from the underlying slab, in order to initiate the release of the overlying slab from the underlying slab. Once the release has been initiated at e.g. a corner, the release progresses along a line moving away from the released corner area of the slabs.

Figure 3:
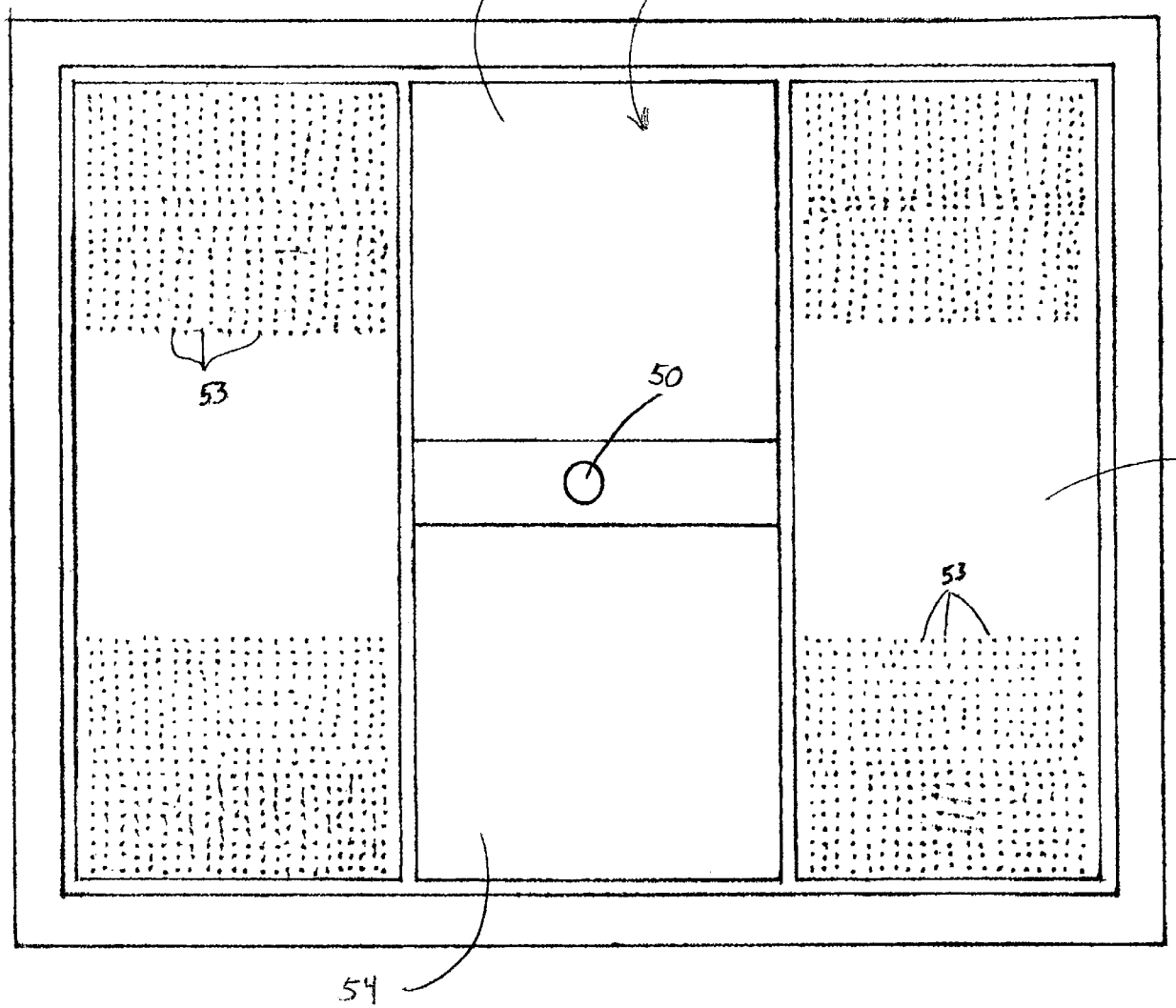
FIG. 3 is a bottom view of a suction plate used for lifting cheese slabs off the slabbed block of cheese, and one embodiment of preferred patterns of suction apertures on the suction plate.

FIG. 3 illustrates a novel suction plate 51 of the invention. As seen in FIG. 3, suction ports 53 are concentrated at the four corners of underlying surface 52 of the suction plate. Accordingly, the suction force exerted by the suction plate is concentrated in the corners of the suction plate. With the suction concentrated in the corners of the suction plate, the lifting force applied to the slab, as plate 51 is lifted by cylinder 50, is concentrated at the corners of the slab. The concentration of the lifting force at the corners, in combination with the relative ease of initiating release at a corner, typically results in one or more of the corners of the slab being released and lifted as cylinder 50 is retracted. Such instances are controlled by the level of adhesion/cohesion between the surfaces of the respective slabs. The level of adhesion/cohesion is controlled, at least in part by the moisture content of the cheese and by the type of cheese. Once release is initiated at a corner, the release progresses from the corner in the normal manner.

In those instances where the slab is not directly released by the lifting forces being concentrated at the corners of the slab, a worker may still need to manually release a corner of the slab to initiate release, but the amount of force required in such manual assist effort is substantially reduced as compared to the effort required where the lifting forces are evenly distributed over the lower surface of the lifting plate.

Figure 5A:
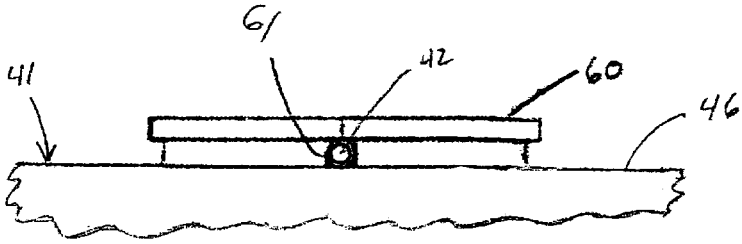
FIG. 5A is a top view of a pair of the pulleys of FIG. 4, shown in relation to the harp frame.
Figure 5:
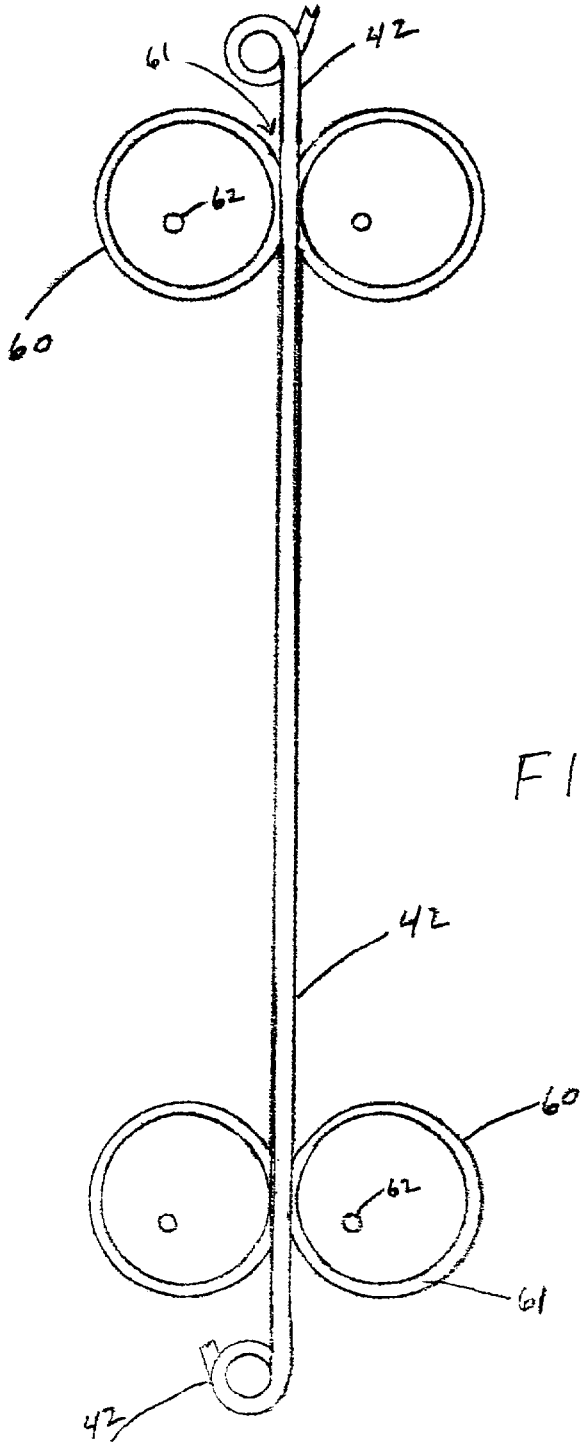
FIG. 5 is a rear elevation view of two pairs of opposed harp pulleys, the two pairs being spaced from each other at upper and lower portions of the harp frame, each pair of pulleys creating a channel for receiving a harp wire.

While the suction apertures are shown in FIG. 5 in square or rectangular configurations, confined to the corners of plate 51, a wide variety of aperture configurations can be used to concentrate the suction forces at corner areas of lower surface 52. Such concentration can be achieved, for example and without limitation, by a wide variety of aperture arrangements which can concentrate suction according to aperture distribution, aperture size, cross-section and/or configuration of individual apertures. Alternatively, or in combination, the suction forces can be concentrated at the corners by effecting distribution of the suction forces internally of plate 50 such as by valving, so as to exert more suction at some apertures and less suction at other apertures. Whatever the mechanism, the object is to exert more suction at at least one corner of the suction plate than the average suction being exerted over the composite of the area of the suction plate.

After a slab is lifted free, slab lifter 49 transports the slab to underlying feed conveyor 33 (FIG. 4) and releases the slab onto the conveyor. Conveyor 33 includes a number of support and drive rollers, supporting and driving a belt which underlies and supports the slab. Conveyor 33 drives the slab toward slab cutting harp 43 as indicated by directional arrow 35 in FIG. 4. As a slab 13 travels along conveyor 33, the slab encounters overlying slab drive conveyor 32. Overlying slab drive conveyor 32 is located above underlying slab feed conveyor 33, the overlying slab conveyor being parallel to, and otherwise aligned with, underlying feed conveyor 33. Overlying conveyor 32 is positioned above feed conveyor 33 a selected distance, the distance preferably being sufficiently less than the thickness of slab 13 to develop squeezing pressure on the slab as the slab progresses in the space between conveyors 32 and 33. In addition or in the alternative, conveyor 32 can be e.g. spring biased against underlying conveyor 33 or conveyor 33 can be spring biased against conveyor 32. Slab 13 is effectively urged into the space between the upper and lower conveyors, and thus toward cutting harp 43, by driving forces transmitted by the surfaces of the belts associated with the respective conveyors in contact with the respective upper and lower surfaces of the slab of cheese as the conveyors transport the slab toward cutting harp 43.

Surfaces 55U and 55L of respective upper and lower belts 56U and 56L of conveyors 32 and 33 are designed and configured to press inwardly on the surfaces of the slab without breaking the surfaces of the slab. Thus, the surfaces of belts 56U, 56L can be e.g. rippled, grooved or otherwise contoured, so long as the surface contours of the belts are sufficiently gentle to not routinely break or cut the surfaces of the slabs. In that regard, belts 56U, 56L can be endless and continuous flexible belts having e.g. protrusions thereon which extend toward the respective surfaces of the slabs. Preferred surfaces for such belts include 2-dimensional arrays, continuous or intermittent, of protuberances extending along the respective belt surfaces. The protuberances are sufficiently deep to protrude into and thereby grip the upper and/or lower surfaces of the slab of cheese. The protuberances are sufficiently gentle in contour (e.g. hemispheres or cylinders) as to not cut or tear the cheese upon projection of such protuberance into the slab of cheese.

Figure 4:
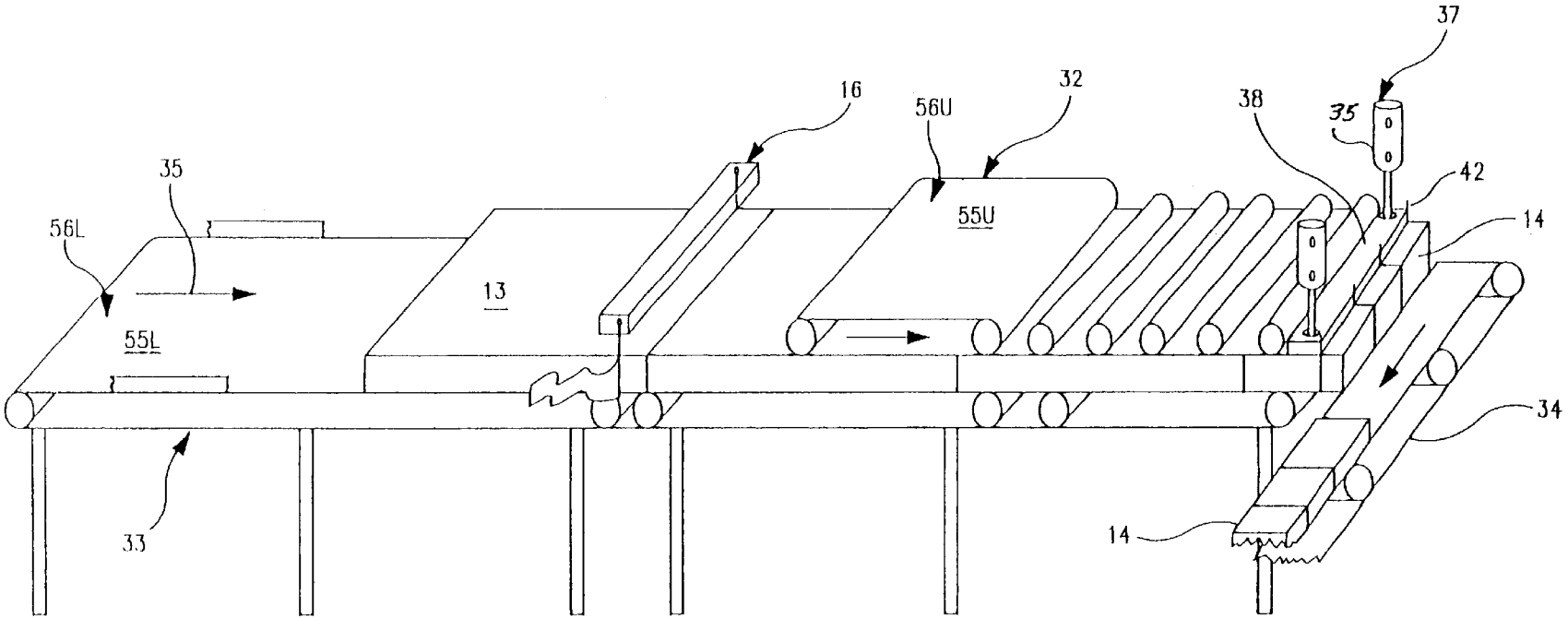
FIG. 4 is a pictorial view of a second embodiment as in FIG. 2 employing a second embodiment of the overlying conveyor, and showing side trimmers.
Figure 4A:
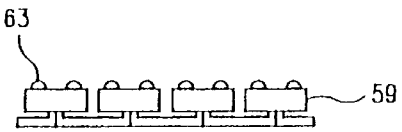
FIG. 4A is a fragmentary side elevation of tank-track type surface for the slab feeding conveyor.

In some embodiments, illustrated in FIG. 4A, the rollers are replaced by an intermittent substrate such as discrete bars 59 extending across the width of the conveyor, with one or more protrusions 63 extending across the width of the conveyor on each such substrate bar or on selected such substrate bars. The bars can be linked to each other e.g. by a chain-link drive e.g. at opposing sides of the conveyor. Preferred protrusions on such substrate bars are shaped as longitudinally extending elongate sections of elongate cylinders extending along the full width of the conveyor. Such bar and chain configurations resemble a set of "tank tracks" sufficiently thick and rigid to support the above discussed squeezing force, wherein respective ones of such tracks bear such arcuate elongate protrusions. Such tank track structures are illustrated in side elevation view in FIG. 4A.

In the alternative, and instead of "tank tracks", the protuberances can be mounted on a less robust substrate such as the above noted flexible, endless belts, and supported by suitable back-up plates where the belts are to applying the squeezing force on the slab. Back-up plates can as well be used to support "tank-track" type structures.

Whatever the conveyor structure, the conveyors use the protruding surface elements in combination with the compression force provided by conveyors 32 and 33 to grip the slabs sufficiently to drive the slabs toward and through cutting harp 43. The use of such driving conveyors to drive the slabs through harp 43 eliminates the need for a slab pusher whereby slabs can be continuously fed through harp 43 with a trailing slab optionally always in abutting relationship with the next leading slab.

Figure 2A:
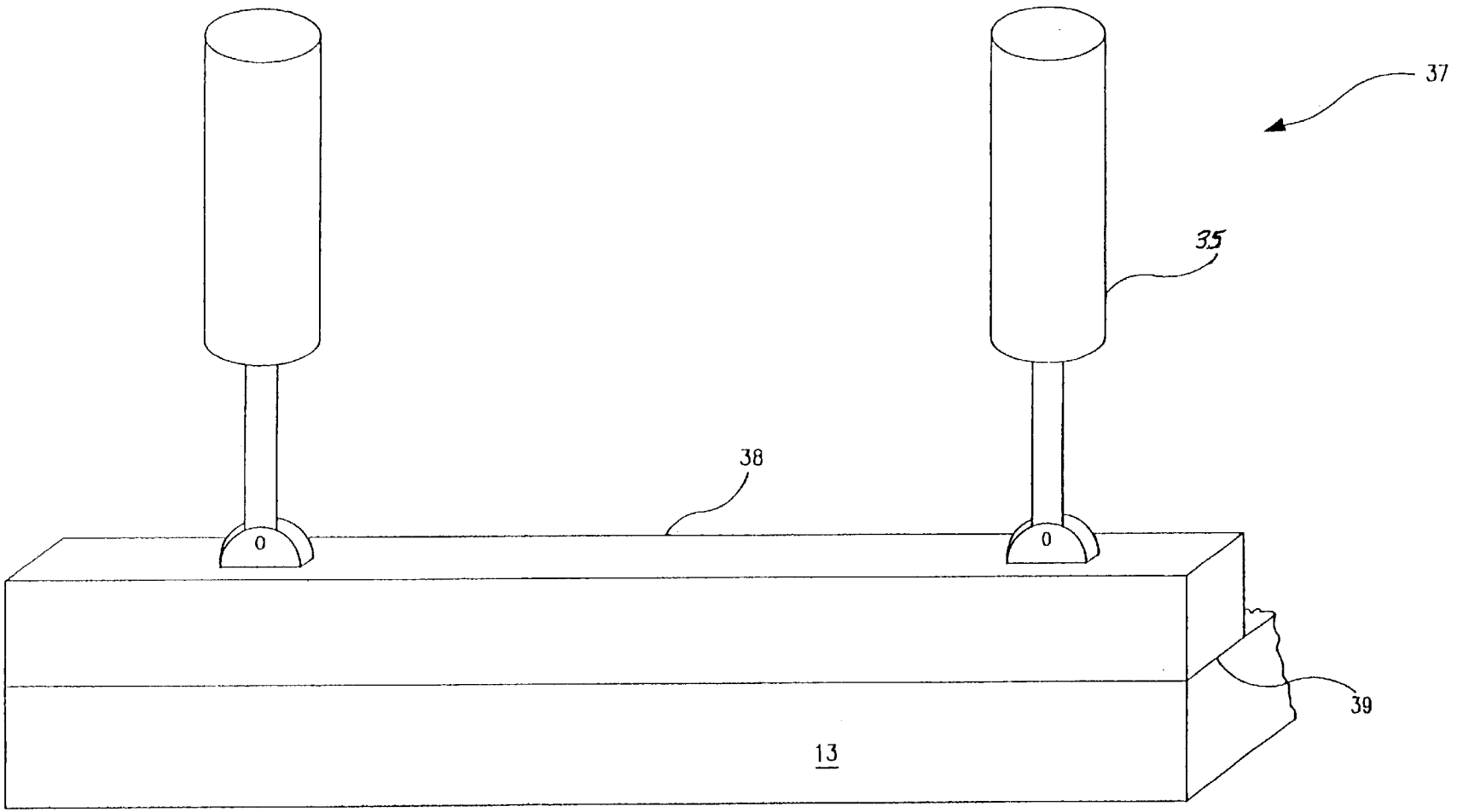
FIG. 2A is a fragmentary pictorial view of a pressure bar initially illustrated in FIG. 2, engaged with a slab of cheese adjacent the cutting harp.

Referring back to FIGS. 2 and 2A, pressure assembly 37 comprises a pair of e.g. pneumatic cylinders 35, and a pressure plate 38, the pressure plate having a pressure surface 39 engaging a slab 13 of cheese. Pressure assembly 37 is located above feed conveyor 33, or above a support plate 29 extending from an end of conveyor 33, and is fixedly mounted proximate an end of feed conveyor 33, adjacent cutting harp 43. Pressure assembly 37 applies pressure to the top surface of a slab of cheese, to stabilize the slab or slab portion while cutting harp 43 is making transverse cuts in the slab of cheese.

Referring now to FIGS. 5, 5A, 6, 7, and 8, cutting harp 43 includes a harp frame 41. Harp frame 41 extends as a perimeter about, and defines, an inwardly disposed aperture 45. A desired number of harp wires 42 are securely mounted to rear surface 46 of harp frame 41, rear surface 46 being the side of the harp first approached by cheese slabs 13. In the illustrated embodiment, and with the harp oriented as used in the cheese slab cutting process, wires 42 extend, along parallel vertical paths across aperture 45.

Figure 8:
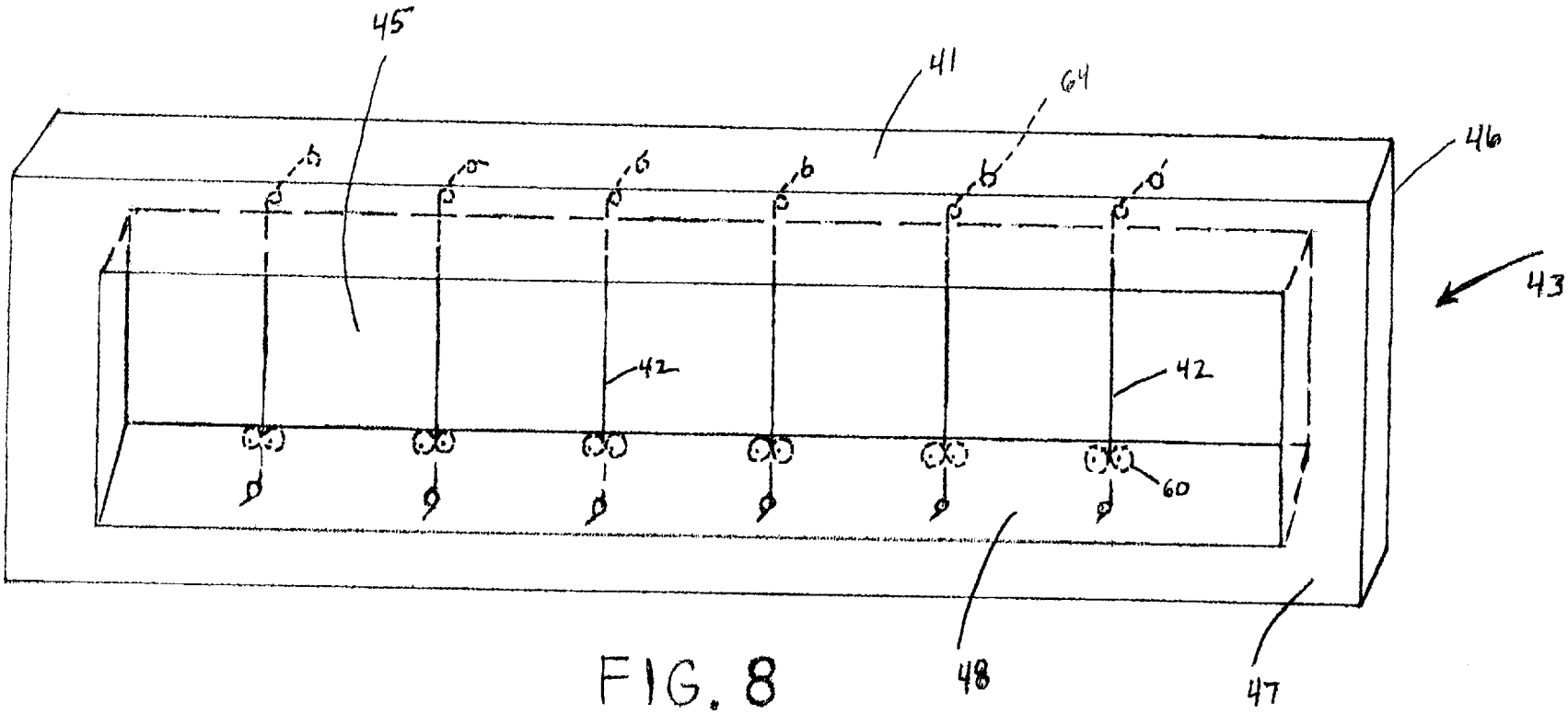
FIG. 8 is a front pictorial view of the harp showing cutting wires mounted between distal opposed pairs of harp pulleys, which pulleys are secured to the cutting harp frame.

Referring to FIGS. 5, 5A, and 8, each wire 42 passes through a harp pulley slot 61 created by a pair of opposed harp pulleys 60, and is thence anchored to the harp frame at a respective anchor stud 64. As seen in FIG. 5A, a harp pulley slot 61 is created by collective steps in the diameters of respective of harp pulleys 60. The pulley slot does not trap the harp wire. Rather, slot 61 positions and guides the wire, without forcing the wire immovably against frame 41 or trapping the wire between the pulleys.

To that end, pulleys 60 are mounted to frame 41 about axes 62 displaced from the respective centers of the pulleys, such that by rotating the pulleys about axes 62, the wires can be moved minor distances laterally across the width of the harp, and thus across the width of the feed conveyor, so as to modify the widths of the cheese chunks cut by the respective wire. Thus, cooperative rotation of any respective pair of pulleys 60 results in lateral movement of the respective slot 61, and corresponding lateral movement of the harp wire 42 being guided by that slot.

Each individual harp wire 42 can be a single piece of wire, or can be comprised of multiple strands which form the respective harp wire. Each individual harp wire 42 is typically comprised of a high tensile strength stainless steel. However, each harp wire may permissibly be made of any material known in the art which can function to effectively slice through cheese or other soft food product, and which is suitable for use in direct contact with food.

Harp wires 42, along with mounting pulleys 60, can be replaced by any cutting device which can be mounted on harp frame 41, and which is operative to make cuts extending through the e.g. cheese food product and across the harp opening adjacent respective ones of the cutting devices. Such cutting devices must be suitable for mounting on a harp frame, so as to move the cutting devices, and the cutting effect, as the harp moves. As effective such alternative cutting devices there can be mentioned, for example and without limitation, laser cutters and high pressure water jet cutters.

Figure 6:
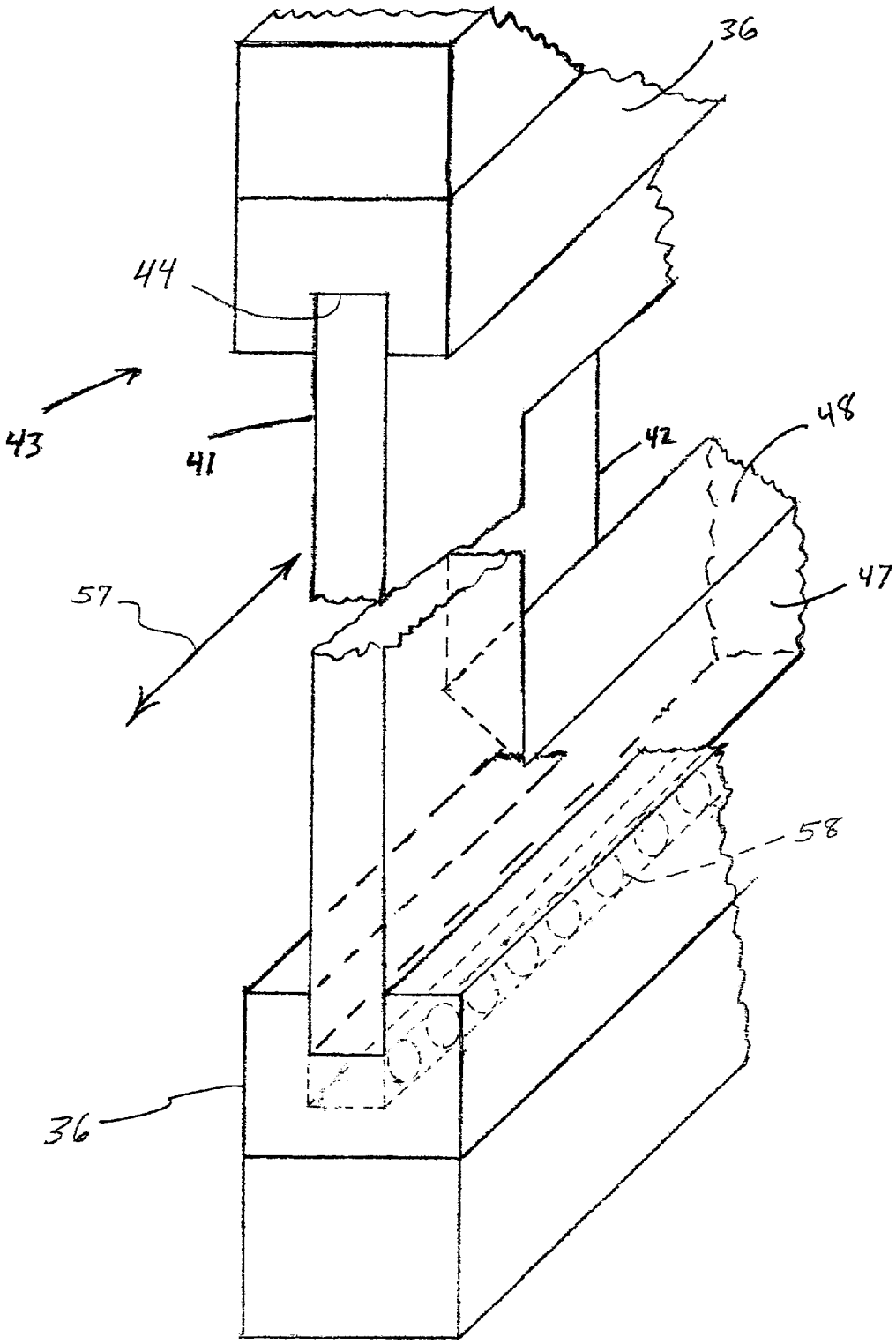
FIG. 6 is a fragmentary pictorial view of a cutting harp of the invention, having a downwardly angled lower leg of the harp frame, and which harp can be moved transverse to the direction of advance of the cheese.
Figure 7:
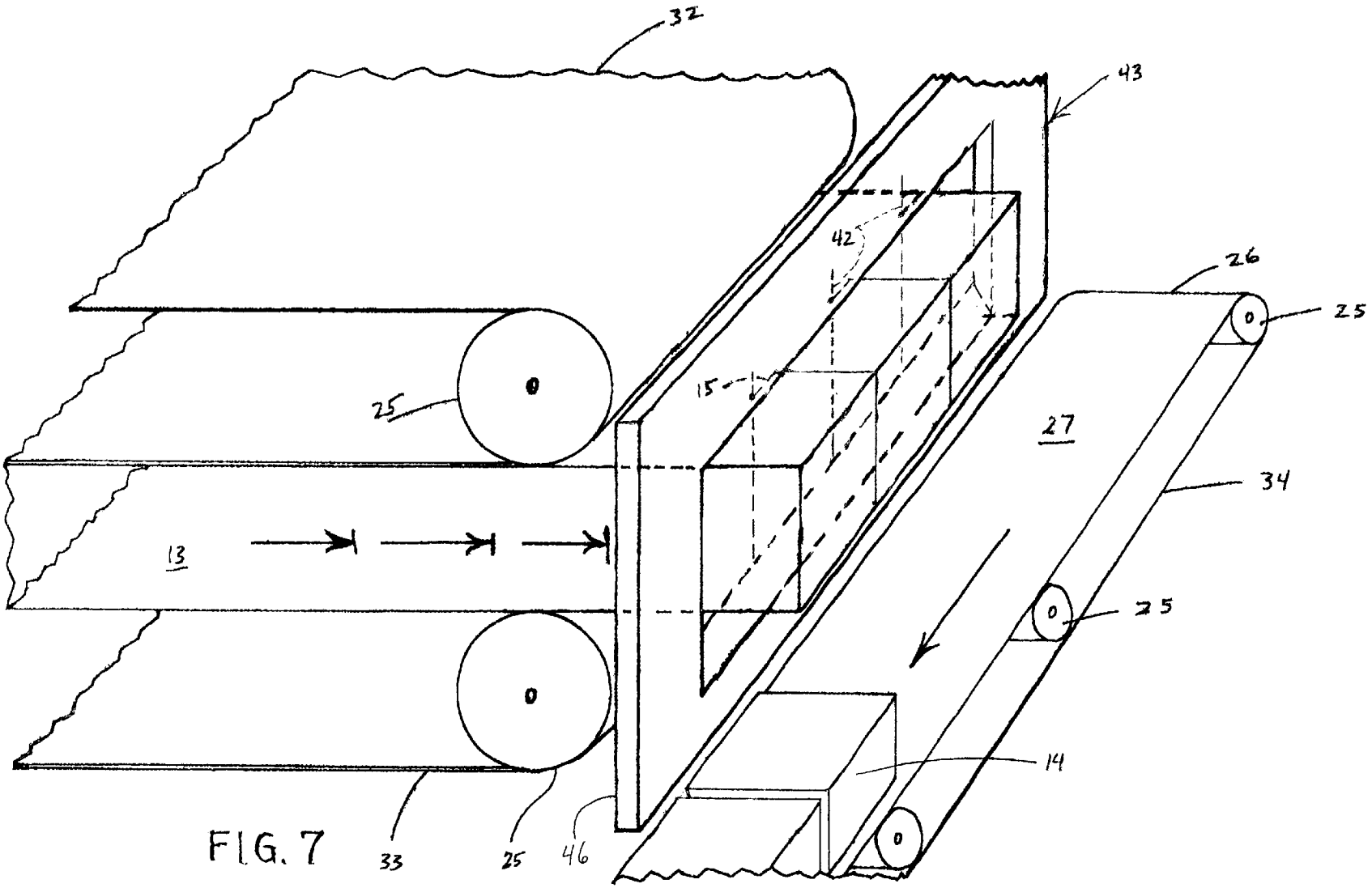
FIG. 7 is a pictorial view of the underlying feed conveyor and the overlying slab feed conveyor proximate the transverse cutting harp, the cuts being made by the cutting harp as the underlying and overlying conveyors push the slab through the cutting harp.
Figure 10:
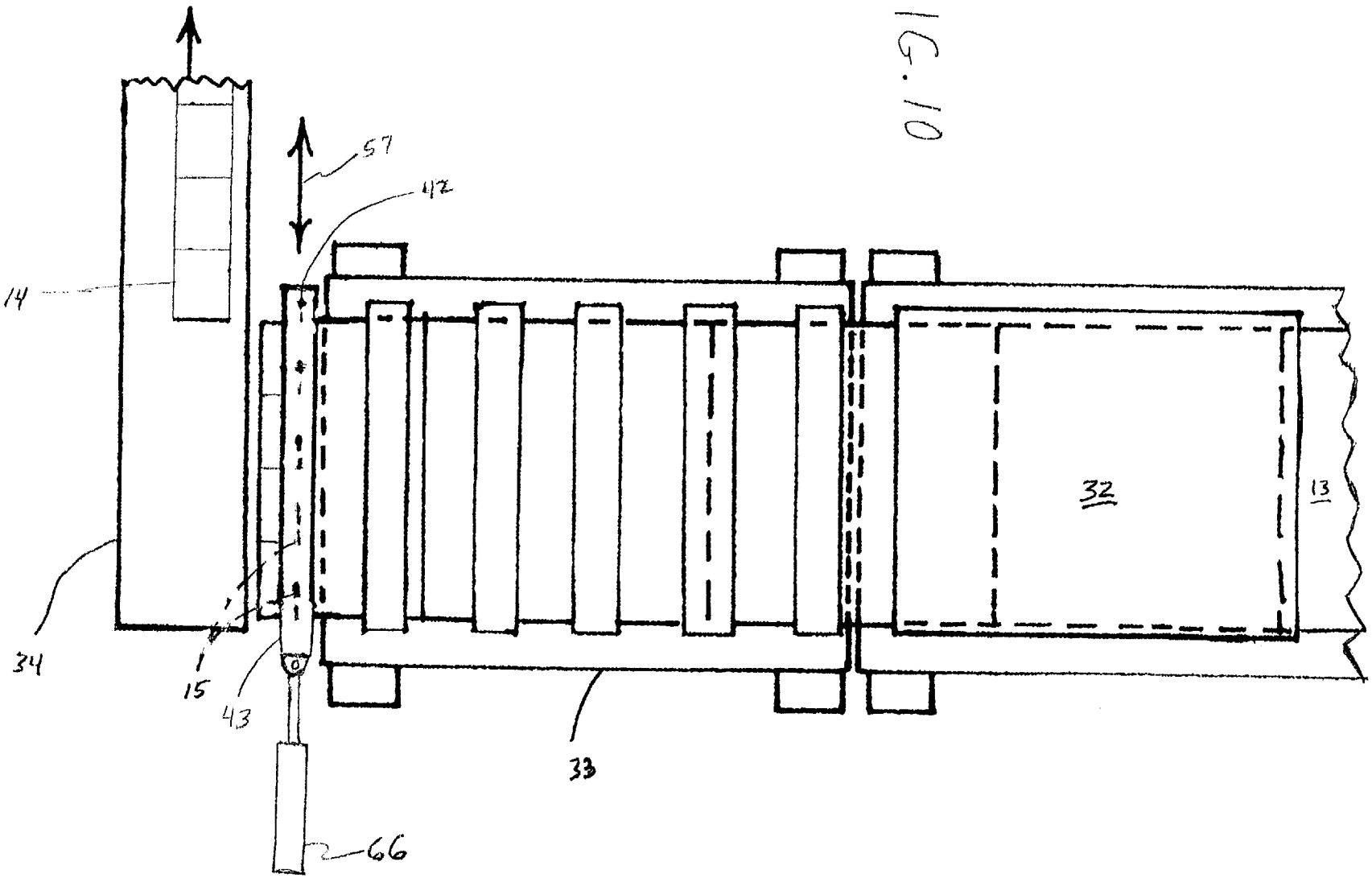
FIG. 10 is a top view of a slab feeding conveyor such as in FIG. 3, showing an intermediate stage of the cut made by the transversely shifting cutting harp as well as showing the take-away conveyor transporting chunks of cheese away from the cutting harp.
Figure 11:
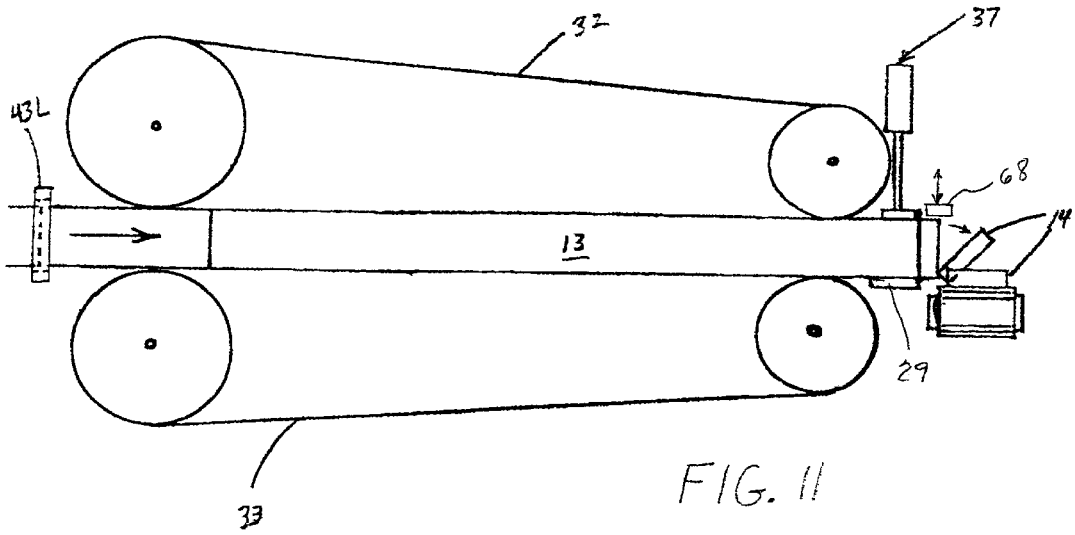
FIG. 11 is a side elevation view of upper and lower slab conveyors working in combination with a pressure bar, a first cutting harp, a second cutting harp, and the take-away conveyor.
Figure 10A:
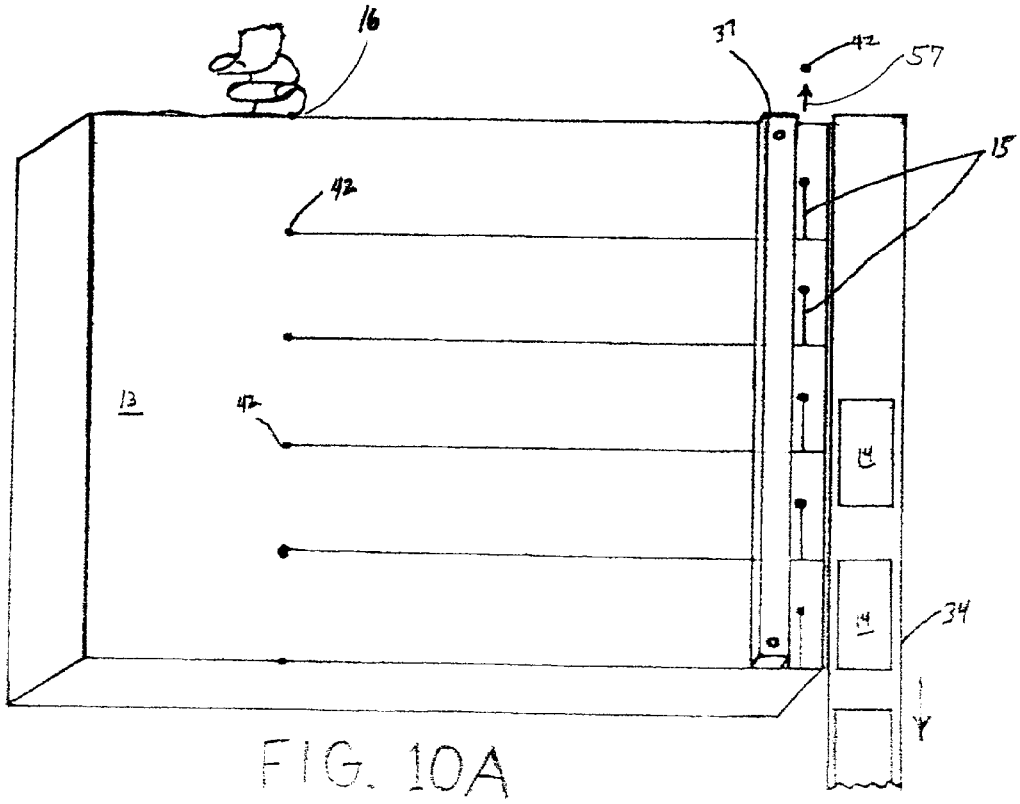
FIG. 10A is a top pictorial view showing a first set of harp wires making longitudinally-extending cuts in a slab of cheese and a second set of harp wires making transversely extending cuts in the slab of cheese thus to release individual chunks of cheese from the slab.

Referring to FIG. 6, as well as to FIGS. 7, 10, and 10A, frame 41 of harp 43 is mounted for transverse sliding or rolling movement in upper and lower slots 44 of harp holder 36, in the directions indicated by the directional arrows 57. Frame 41 can move with slide bearing engagement as illustrated in FIG. 6. In the alternative, either lower slot 44 or the lower surface of frame 41 which engages slot 44, may contain e.g. wheels, ball bearings, or other moving bearing surfaces 58 as suggested in dashed outline, for facilitating transverse movement of frame 41 in slot 44.

Referring to FIG. 4, a slab 13 is driven under pressure bar 38 by the driving action of conveyors 32, 33. The slab passes through edge trimmer 16 where the edges of the slab are trimmed. The slab subsequently enters aperture 45, and encounters cutting wires 42 as it begins to advance through the cutting harp. As conveyors 32, 33 continue to urge slab 13 through harp 43, wires 42 cut into, and vertically slice, the slab of cheese. As slab 13 is sliced, at least a portion of the length of the slab, as measured along the path of movement of the slab, enters aperture 45 and extends outwardly on the exit side, or front face, of the harp. When a desired length of the vertically sliced slab 13 has passed beyond wires 42, upper and lower slab conveyors stop, cylinders 35 extend pressure plate 38 downward, and pressure plate 38 applies a downward force on the slab immediately adjacent harp 43, against the support of support plate 29, holding the slab immobile against conveyor 33. With pressure assembly 37 holding the slab down against support plate 29, immediately adjacent harp 43, a lateral force is applied to harp 43 by e.g. cylinder 66 illustrated in FIG. 10.

The harp, and the attached harp wires 42, thus move transversely to the direction of advance of the slab of cheese and thereby make transverse cuts 15 in slab 13. This transverse vertical cutting, being perpendicular to the vertical cutting associated with advance of the cheese slab into harp 43 along the path of advance of the slab, is illustrated in FIGS. 7, 10, and 10A. The transverse cuts 15 form and create the back surface of each cheese chunk 14 so created.

Figure 7A:
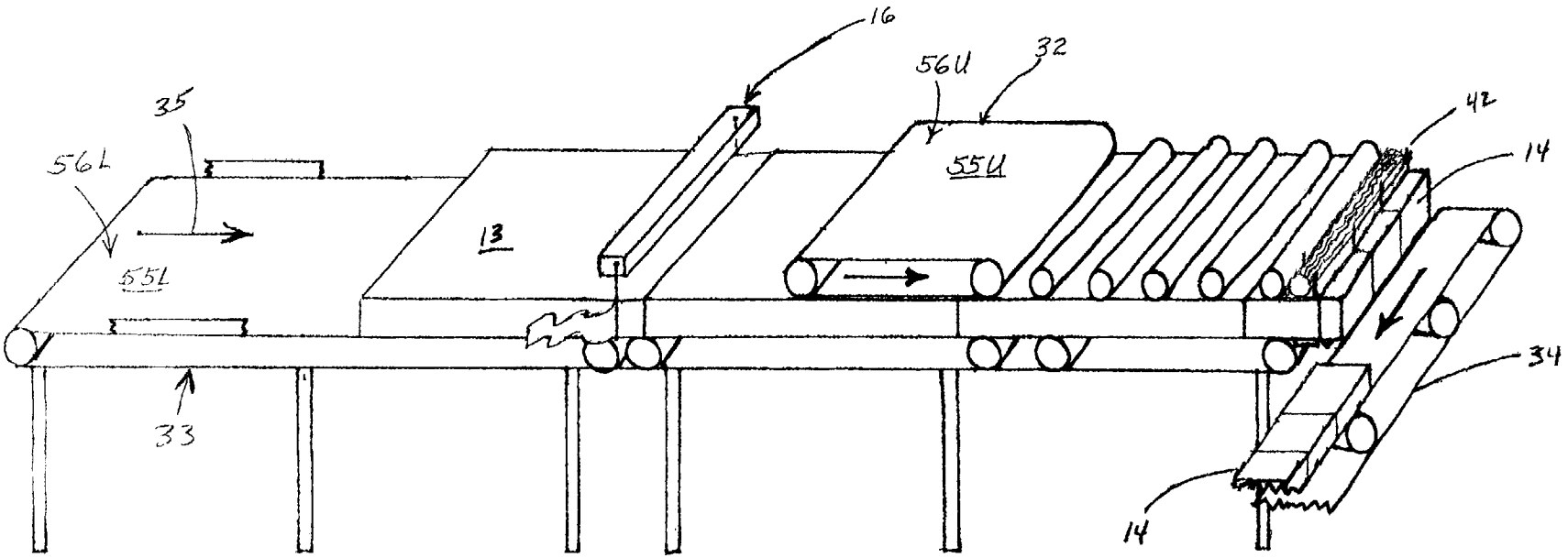
FIG. 7A is a side elevation of the underlying and overlying conveyors adjacent the cutting harp, including a ribbed or surface textured hold-down roll stabilizing the cheese slab while the harp makes upstanding cuts in the slab of cheese.

FIG. 7A illustrates alternative structure for pressure assembly 37. As suggested by FIG. 7A, pressure plate 38 is replaced by a pressure roll 38R. While cheese slabs are being driven through harp 43, force is continuously applied to pressure roll 38R by cylinders 35 (not shown in FIG. 7A), thus continuously holding the pressure roll down against the respective slabs immediately adjacent the cutting harp. Pressure roll 38R preferably has a textured surface, such as a corrugated or other surface bearing protrusions so as to assist in stabilizing the cheese slab. The specifications for protrusions on pressure roll 38R are generally the same as for the protrusions illustrated at 63 on conveyors 32 or 33, though the protrusions on pressure roll 38R need not be the same as the protrusions on conveyors 32, 33. A substantial advantage of the use of pressure roll 38R, instead of pressure bar 38, is that the processing need not stop and wait for application of pressure by the pressure bar, because such appropriate pressure is constantly being applied at pressure roll 38R.

In cutting the back surface of the cheese chunk, harp 43 is moved transversely a distance sufficient to cut off each of the respective chunks from the advancing slab, effectively severing chunks 14 from the slab 13. Thus, the distance of transverse movement is at least as great as the spacing between the respective ones of wires 42. As the newly formed chunks of cheese are cut from the slab, the chunks fall onto, or are otherwise received by, take-away conveyor 34. The transverse movement of the vertical slicing harp, alone or in combination with the effect of gravity on the chunks of cheese, cantilevered as they are from harp 43, typically "unsticks," and breaks the chucks of cheese away from the remaining portion of the slab on conveyor 33. Thus, no manual labor need be routinely employed for breaking the chunks being formed at harp 43 away from the trailing portion of the slab.

Referring to FIG. 6, in preferred embodiments, upper surface 48 of the lower leg of frame 41 is angled downward toward front frame surface 47. With the upper surface of the lower leg of frame 41 thus disposed at a downward angle, the only support underlying a cut chunk is the line contact at the extreme rear of the lower leg of the frame where the upper edge of surface 48 meets rear surface 46 of the frame, whereby gravity is further employed to "unstick" the cheese chunks after the cheese passes through the harp. The downward pull of gravity, augmented by the limited support at downward angled surface 48, urges the freshly cut cheese chunks to break away from the trailing portion of the slab and to fall toward take away conveyor 34 where the individual cheese chunks can be further transported and processed. If necessary, should gravity fail to completely unstick the cheese chunks from the slab, a break-away bar 68 can be employed to apply downward pressure against chunks 14 to ensure that the cut chunks are completely separated from the slab.

Figure 9:
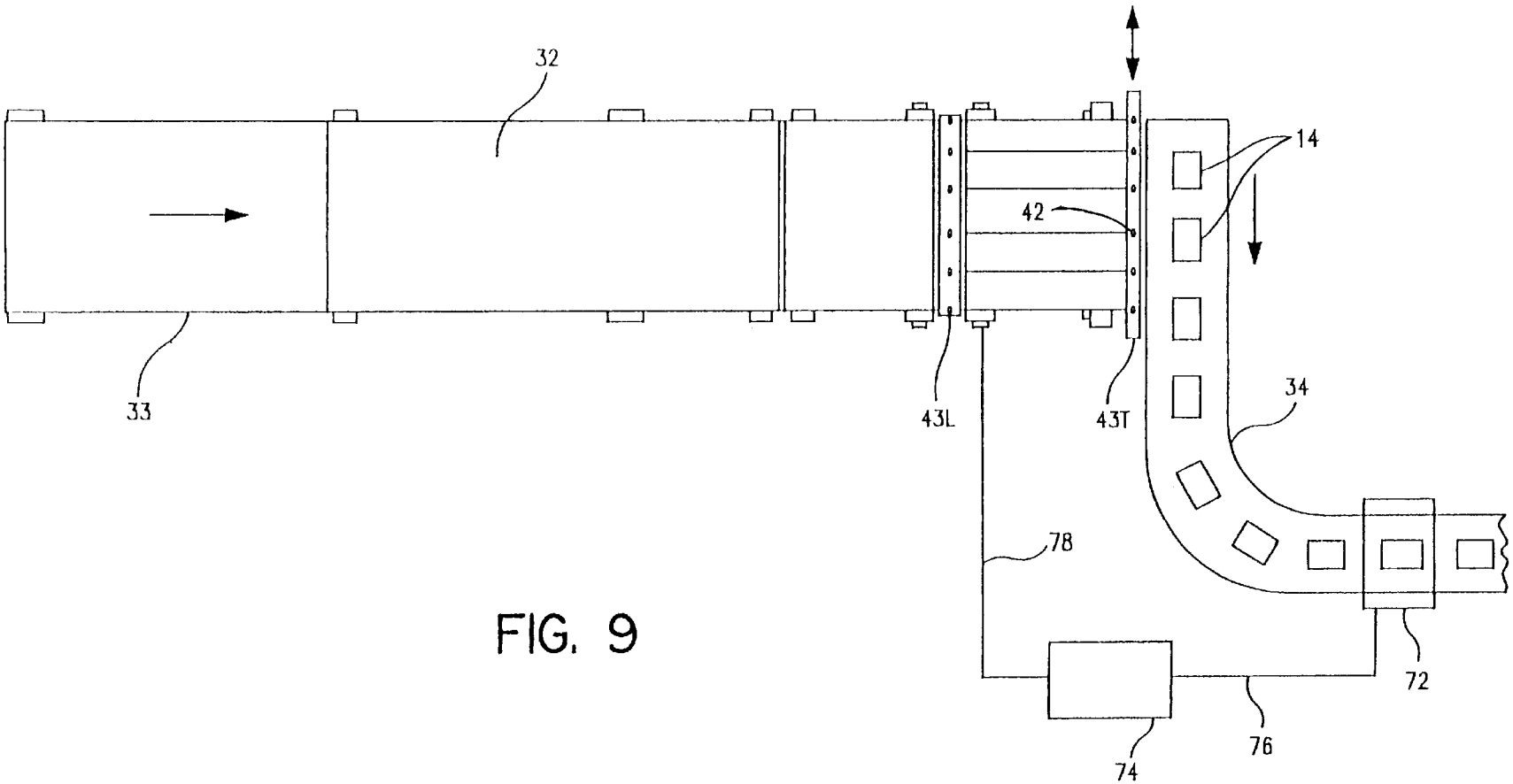
FIG. 9 is a top view of another embodiment of slab cutting apparatus of the invention, employing both first and second slab cutting harps.

In some embodiments, the combined longitudinal and transverse cutting illustrated for harp 43 is accomplished using two harps along conveyor 33 as illustrated in FIG. 9. The use of two vertical slicing harps reduces the wear and tear on a given harp, especially on wires 42. Thus, a lead harp 43L is generally stationary and makes longitudinal cuts in the cheese slab as the slab advances through the harp. A trailing harp 43T makes no longitudinal cuts and makes all the transverse cuts. In order to ensure that the wires of harp 43T remain in alignment with the cuts made by harp 43L, and thus do not further longitudinally cut the slab, guide plates may extend from proximate the cutting wires in harp 43L toward harp 43T e.g. along the cut lines cut in the slab by the wires of the lead harp 43L. Such guides may comprise thin sheets of metal and be positioned along the length of conveyor 33 and aligned to receive and guide a freshly sliced portion of cheese from harp 43L toward harp 43T. In the alternative, small upwardly-extending blunt shields can be positioned adjacent and upstream of the positions of the cutting wires in harp 43T which are in alignment with the longitudinal cuts made at harp 43L, so as to guide the edges of the cheese, where cut by wires 42 of harp 43L, around wires 42 in harp 43T until such time as harp 43T makes a transverse cutting movement.

It is contemplated, though not preferred, that harp 43T can make some, and less than all, longitudinally-extending cuts. In any event, the harps 43L and 43T are coordinated with each other so as to cooperatively cut chunks from the slab, whereby the lead harp makes only longitudinal cuts along the path of travel of the cheese slab, to create ribbons of cheese from the slab, and the trailing harp makes only transverse cuts across the path of travel of the cheese slab, thus across the ribbons cut by harp 43L, to sever cheese chunks from the respective ribbons of the slab or makes the transverse cuts in combination with a portion of the longitudinal cuts.

Referring to e.g. FIGS. 9 and 10A, take away conveyor 34 is located at the end, or just downstream of the end, of slab feed conveyor 33 at the position where cutting harp 43 acts to sever the chunks of cheese from the slab. Take away conveyor 34 typically runs perpendicular to the direction of slab feed conveyor 33 and is located below conveyor 33, positioned to receive the chunks falling from harp 43.

Figure 12:
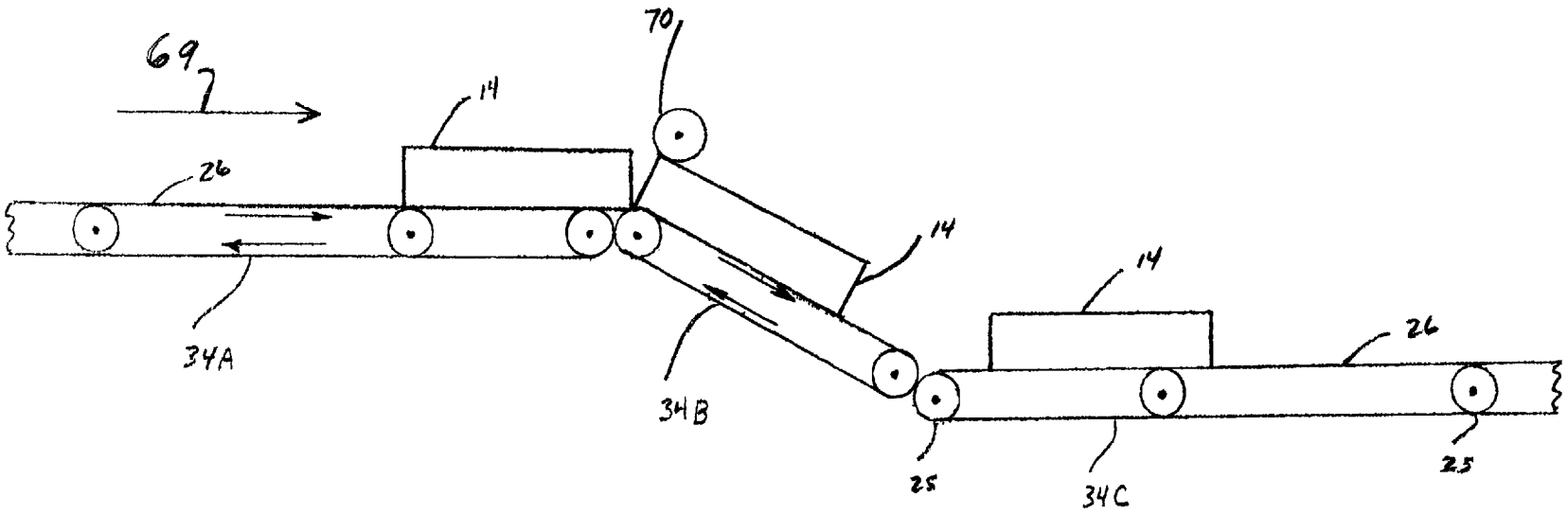
FIG. 12 is a side elevation view of first, second and third segments of the take-away conveyor working in combination with a turning idler roll to separate and break apart the individual chunks of cheese.

FIG. 12 illustrates use of a turning idler roll 70 with separated elements of take away conveyor 34 to further separate the chunks of cheese from each other. For example, typically a plurality of cheese chunks are simultaneously cut from the slab by harp 43. While the falling of the chunks onto take away conveyor 34 separates the chunks from slab 13, the side-by-side contact of the chunks with each other may foster some continued sticking of the chunks to each other as the chunks move along take-away conveyor 34.

As chunks 14 proceed along conveyor 34 in the direction indicated by arrow 69, the chunks encounter roll 70 which is positioned to marginally interfere with movement of the chunks along a straight-angled path along conveyor 34A. When a chunk reaches idler roll 70, the chunk is biased downward by the roll onto conveyor section 34B. As chunks 14 are urged along the direction of travel of conveyor 34, and biased downward by roll 70, any sticking of adjacent chunks to each other at respective leading, trailing surfaces of the respective chunks, is broken as the corresponding leading chunk is forced to change by a small downward angle by the interference of roll 70. To assist in the separation, conveyor segment 34B is driven at a speed greater than that of conveyor segment 34A, whereby longitudinal separation of individual chunks along the take-away conveyor is achieved. Thus, chunks 14 on take away conveyor 34, when necessary, are effectively "unstuck" and separated from each other by use of a segmented conveyor 34, as conveyor elements 34A, 34B, and optionally 34C.

Chunks 14 are then preferably routed to a weighing and wrapping station 72, illustrated in FIG. 9. Individual weights are sent by signal line 76 to controller 74, where the weights are compared to desired weights. Where variances in weight are detected over a suitable sampling of the chunks, a correction signal is sent to conveyor 33, and the distance by which cheese slab 13 advances between transverse cuttings by harp 43 is adjusted accordingly. If the sensed weights are heavier than desired, the distance of advance between transverse cuttings is reduced. If the sensed weights are lighter than desired, the distance of advance between transverse cuttings is increased. By so sensing the weight of a sampling of the chunks so cut, or all the chunks so cut, the weights of the chunks can be automatically maintained within a desired tolerance of weights.

The computer controller linking, and automatic weighing and adjustment of distance of advance of the slab between transverse cuttings by harp 43, allow and enable the computer to automatically adjust the size of subsequently cut chunks of cheese according to the data collected from already-cut chunks of cheese.

While the invention has been described for use with cheese cutting, it is contemplated that the invention described herein can easily be adapted for use with cutting or slicing a multitude of products, e.g. soap, wax, chocolate, candy, as well as other products and foods.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A cutter for cutting slabs of food product into smaller chunks, said cutter comprising:

(a) a feed conveyor having an intake end and a discharge end, and a conveying surface for conveying such slabs of food product thereon;

(b) slab drive apparatus for driving such slabs of food product along said feed conveyor in a direction from said intake end toward said discharge end;

(c) a cutting harp disposed adjacent said discharge end of said feed conveyor, said cutting harp comprising a frame, a central opening inside said frame, and cutting wires extending across the opening, the cutting wires being operative to make cuts extending through the food product, the opening being aligned with said feed conveyor such that a slab being discharged from said feed conveyor passes through the opening and such that, when such slab of food product is driven through the opening in said harp, said cutting wires effect cuts in such food product in the direction of advance of such slab of food product; and (d) transverse harp drive apparatus, for driving said harp in a direction transverse to the direction of advance of such slab, and generally parallel to the conveying surface of said feed conveyor, thereby to sever chunks of such food product from such slab, said cutting harp being longitudinally stationary and transversely mobile with respect to the direction of drive of such food product toward said cutting harp.

2. A cutter as in claim 1 wherein said cutter is a cheese cutter and wherein said food product is cheese.

3. A cutter as in claim 1, including a hold-down bar, mounted for reciprocal movement into and out of engagement with such slab of food product, adjacent said cutting harp, and for biasing such food product against said feed conveyor while said harp is being driven in the transverse direction.

4. A cutter as in claim 2, including a hold-down roller adjacent said cutting harp, biased to continuously urge such food product against said feed conveyor adjacent said cutting harp.

5. A cutter as in claim 1, wherein such slab of food product is driven through the opening in said harp by a predetermined distance between subsequent events of transverse driving of said harp, said cutter further including a take-away conveyor taking such severed chunks away from said cutting harp, further including a weighing device for weighing individual ones of such chunks, and a controller receiving weight readings from said weighing device, and, based on one or more weight readings, sending an adjustment instruction to said slab drive apparatus to thereby adjust the predetermined distance of advance of the slab of food product between transverse cuttings of additional lengths of food product to be weighed.

6. A cutter as in claim 2, wherein such slab of food product is driven through the opening in said harp by a predetermined distance between subsequent events of transverse driving of said harp, said cutter further including a take-away conveyor taking such severed chunks away from said cutting harp, further including a weighing device for weighing individual ones of such chunks, and a controller receiving weight readings from said weighing device, and, based on one or more weight readings, sending an adjustment instruction to said slab drive apparatus to thereby adjust the predetermined distance of advance of the slab of food product between transverse cuttings of additional lengths of food product to be weighed.

7. A cutter as in claim 5, the take-away conveyor being configured to transport the severed chunks in a direction transverse to the longitudinal movement of the slabs of food product, said cutter including a breaker bar downstream of and adjacent said harp and adjacent the take-away conveyor, for engaging top surfaces of the severed chunks and urging such chunks away from said harp and onto the take-away conveyor.

8. A cutter as in claim 1 wherein said slab drive apparatus comprises said feed conveyor providing underlying support of the slab of food product at a feed conveyor support surface, and an overlying conveyor extending along said feed conveyor in facing relationship with said feed conveyor, for interfacing with such slab of food product at an overlying conveyance surface, a conveyance cavity thus being defined between said feed conveyor support surface and said overlying conveyor conveyance surface, said feed conveyor and said overlying conveyor being cooperatively driven at a common speed, at least one of said feed conveyor and said overlying conveyor being biased by a biasing force against the other of said feed conveyor and said overlying conveyor through such slab of food product, with sufficient compression of such slab of food product that said overlying and underlying conveyors collectively drive such slab through said cutting harp.

9. A cutter as in claim 8, at least one of said support surface and said conveyance surface comprising protrusions spaced about the respective surface for engaging such slab of food product whereby the biasing force between overlying and underlying conveyors presses the protrusions into such slab of food product, thus to assist in advancing such slab of food product through said harp.

10. A cutter as in claim 8 wherein said cutter is a cheese cutter.

11. A cutter as in claim 2 wherein said cutting wires on said harp are mounted to said frame by eccentric mounting wheels whereby said cutting wires can be moved transversely of a path of advance of said slab of food product by rotating respective ones of said mounting wheels thereby to adjust a transverse dimension of such food product which is being cut.

12. A cutter as in claim 5 and including periodically up-dating the incremental predetermined distance of advance of the slab of food product between transverse cuttings of additional lengths of food product to be weighed.

13. A cutter as in claim 6 and including periodically up-dating the incremental predetermined distance of advance of the slab of cheese between transverse cuttings of additional lengths of cheese to be weighed.

14. A method of advancing a slab of cheese into and through a cutting harp, and thereby cutting the slab of cheese, the method comprising:

(a) positioning the slab of cheese between a first underlying feed conveyor having a support surface, and a second overlying conveyor having a conveyance surface;

(b) biasing at least one of the first and second conveyors against the other of the first and second conveyors through the slab of cheese, with sufficient compression of the slab of cheese that the overlying and underlying conveyors can collectively drive the slab in a direction through the cutting harp, the cutting harp being longitudinally stationary and transversely mobile with respect to the direction of driving the slab of cheese through the cutting harp;

(c) driving at least one of the first and second conveyors, as slab drive apparatus, in a direction toward the harp, such that friction forces of the support surface and the conveyance surface drive the slab of cheese into and through the cutting harp, thereby cutting the slab of cheese; and (d) moving the harp transversely across the slab of cheese, and generally parallel with the support surface of the underlying conveyor, and thereby cutting respective chunks of cheese.

15. A method as in claim 14, including stopping advance of the slab before moving the harp transversely to cut the chunks.

16. A method as in claim 14 wherein both of the first and second conveyors bear protrusions spaced about the respective support surface and the conveyance surface such that protrusions on both of the first and second conveyors participate in driving the slab of cheese into and through the cutting harp.

17. A method as in claim 14 including, on an ongoing basis, biasing a hold-down roller against a top surface of the slab of cheese between the overlying conveyor and the harp and thereby stabilizing the slab of cheese against substantial transverse movement while moving the harp transversely across the slab.

18. A method as in claim 17, including intermittently biasing a hold-down bar against a top surface of the slab of cheese between the overlying conveyor and the harp and thereby stabilizing the slab of cheese against substantial transverse movement while moving the harp transversely across the slab.

* * * * *

UNITED STATES PATENT AND TRADEMARK OFFICE

CERTIFICATE OF CORRECTION

PATENT NO. : 6,655,248 B1
DATED : December 2, 2003
INVENTOR(S) : Charles H. Johnson It is certified that error appears in the above-identified patent and that said Letters Patent is hereby corrected as shown below:

Column 6,
Line 7, delete “an-unoccupied area” and insert -- an unoccupied area -- in place thereof.

Column 11,
Line 29, delete “chucks” and insert -- chunks -- in place thereof.

Signed and Sealed this

Nineteenth Day of October, 2004

JON W. DUDAS
*Director of the United States Patent and Trademark Office*